US010883720B2

(12) United States Patent
Godel et al.

(10) Patent No.: US 10,883,720 B2
(45) Date of Patent: Jan. 5, 2021

(54) ELBOWED COMBUSTION CHAMBER OF A TURBOMACHINE

(71) Applicant: Safran Aircraft Engines, Paris (FR)

(72) Inventors: Guillaume Aurelien Godel, Moissy-Cramayel (FR); Romain Nicolas Lunel, Moissy-Cramayel (FR); Thomas Olivier Marie Noel, Moissy-Cramayel (FR); Matthieu Francois Rullaud, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 111 days.

(21) Appl. No.: 15/569,593

(22) PCT Filed: Apr. 28, 2016

(86) PCT No.: PCT/FR2016/051004
§ 371 (c)(1),
(2) Date: Oct. 26, 2017

(87) PCT Pub. No.: WO2016/174363
PCT Pub. Date: Nov. 3, 2016

(65) Prior Publication Data

US 2018/0299132 A1 Oct. 18, 2018

(30) Foreign Application Priority Data

Apr. 29, 2015 (FR) ..... 15 53876

(51) Int. Cl.
*F23R 3/42* (2006.01)
*F23R 3/06* (2006.01)
*F23R 3/28* (2006.01)

(52) U.S. Cl.
CPC ..... *F23R 3/42* (2013.01); *F23R 3/06* (2013.01); *F23R 3/283* (2013.01)

(58) Field of Classification Search
CPC .... F23R 3/42; F23R 3/283; F23R 3/50; F23R 3/52
See application file for complete search history.

(56) References Cited

U.S. PATENT DOCUMENTS 3,088,279 A 5/1963 Diedrich
4,441,323 A * 4/1984 Colley ..... F23R 3/283 60/737

(Continued)

FOREIGN PATENT DOCUMENTS

GB 2 008 199 A 5/1979

OTHER PUBLICATIONS

Search Report dated Feb. 16, 2016 in corresponding French Patent Application No. FR 1553876 FA 81090 (with English translation of category).

(Continued)

*Primary Examiner* — Craig Kim
(74) *Attorney, Agent, or Firm* — Oblon, McClelland, Maier & Neustadt, L.L.P.

(57) ABSTRACT

A combustion chamber of a turbomachine includes an annular outer casing and a flame tube connected to the outer casing. The flame tube includes an annular inner wall and an annular outer wall defining a first, radial portion at the inlet of the flame tube and a second, axial portion at the outlet of the flame tube. The first portion extends towards the second portion forming an elbow between the inlet and the outlet of the flame tube.

9 Claims, 4 Drawing Sheets

(56) References Cited

U.S. PATENT DOCUMENTS

| | | | | |
|---|---|---|---|---|
| 4,955,201 | A * | 9/1990 | Shekleton | F23R 3/283 60/738 |
| 8,141,368 | B2 * | 3/2012 | Goeke | F02C 7/228 60/773 |
| 9,388,742 | B2 * | 7/2016 | McGee | F23R 3/283 |
| 2007/0084219 | A1 * | 4/2007 | Bernier | F23R 3/002 60/804 |
| 2008/0006033 | A1 | 1/2008 | Scarinci et al. | |
| 2010/0083664 | A1 | 4/2010 | Mancini et al. | |
| 2014/0332602 | A1 * | 11/2014 | Cramb | F23R 3/14 239/104 |
| 2017/0059163 | A1 * | 3/2017 | Ott | F23R 3/283 |
| 2018/0003385 | A1 * | 1/2018 | Rodrigues | F23R 3/286 |
| 2018/0039254 | A1 * | 2/2018 | North | B33Y 10/00 |
| 2018/0209651 | A1 * | 7/2018 | Cai | F23R 3/286 |

OTHER PUBLICATIONS

International Search Report dated Jul. 15, 2016 in PCT/FR2016/051004 (with English translation).

* cited by examiner

ELBOWED COMBUSTION CHAMBER OF A TURBOMACHINE

GENERAL TECHNICAL FIELD

The invention relates to the field of combustion chambers for turbine engines and more particularly to the structure and the attachment of a flame tube in a combustion chamber of a turbine engine.

STATE OF THE ART

In known fashion and in connection with FIG. 1, downstream of a high pressure compressor (not shown), a turbine engine comprises a combustion chamber delimited by inner 1*a* and outer 1*b* rotationally symmetrical casings which are concentric.

The combustion chamber comprises a flame tube 2 arranged in the space defined by the inner 1*a* and outer 1*b* casings.

The flame tube 2 is delimited by inner 2*a* and outer 2*b* walls called inner and outer shrouds, and a chamber base plate 3 which serves as a support for the injectors 4.

Moreover, the combustion chamber also comprises a fairing 5 arranged in front of the chamber base to partially cover the injectors 4 and to protect them against possible shocks (which can be produced by the ingestion of a bird or a block of ice into the engines). And the combustion chamber comprises an air diffuser 6 leading to the injector 4.

The base plate 3, the inner 2*a* and outer 2*b* walls of the flame tube and the fairing 5 are assembled by bolts (not shown).

The combustion chamber of FIG. 1 is said to be direct annular axial in that it extends in the preferred direction of the engine axis without reversal of the cylindrical shrouds of the flame tube. This architecture is the reference point for modern turbine engines, particularly at high power levels. In the low power field, it cohabitates with the reverse chamber architecture which is very compact axially. It has, however, as its main disadvantage a high surface to volume ratio which makes cooling the walls of the flame tube difficult and handicaps their lifetime.

On the other hand, one problem with the direct axial chamber type is that the axial bulk of the flame tube is considerable.

Another problem is that the attachments of the fairing, of the inner 2*a* and outer 2*b* walls and of the base plate are subjected to vibrations of the turbine engine as well as to thermal dilations of the sub-components of the chamber module which can degrade its operation, so that generally complex vibratory and thermal compensation systems are provided.

PRESENTATION OF THE INVENTION

The invention proposes to mitigate at least one of these disadvantages.

To this end, the invention proposes, according to a first aspect, a combustion chamber of a turbine engine, comprising: an outer annular casing; a flame tube connected to the outer casing, said flame tube comprising an inner annular wall and an outer annular wall defining, on the one hand, a first radial portion at the inlet of the flame tube and on the other hand a second axial portion at the outlet of the flame tube, the first portion extending toward the second portion forming an elbow between the inlet and the outlet of the flame tube.

The invention is advantageously completed by the following features, taken alone or in any one of their technically feasible combinations.

The flame tube comprises a chamber base situated at the inlet of the flame tube, the chamber comprising at least one fuel injector for injecting fuel into the flame tube via the inlet of the flame tube, the flame tube being connected to the outer casing through said injector in connection with the chamber base.

The injector has a main direction coaxial with a longitudinal axis Y along which the first portion extends.

The injector comprises an injector body surrounding an injection tube through which fuel is brought into the flame tube, the injector body being inserted into a cylinder topping a connection disk connected to the chamber base.

The inner and outer annular walls of the flame tube are connected to the outer casing through the injector body.

The injector body is connected to the injection tube, the injector body being movable with respect to the cylinder.

The chamber comprises primary holes drilled in the inner and outer annular walls at the first portion and dilution holes drilled in the inner and outer annular walls at an elbow of the flame tube.

According to another aspect, the invention relates to a turbine engine comprising a combustion chamber according to the invention.

The invention allows a strong reduction in the axial bulk of the combustion chamber. This has the following advantages.

- the mass of the engine is reduced:
  - the shape of the flame tube allows a reduction in the length of the outer casing, which is often common with the high-pressure turbine downstream of the combustion chamber;
  - the reduction in length of the equipment—pipes—nacelle and all the "out-of-stream" constituents;
  - the structure of the chamber is simplified, in particular by the fact that the flame tube is connected to the outer casing through the injector, which allows the elimination of the cowling and the associated bolts. These parts are generally used in chambers of the direct axial type;
- the dynamic situation of the high pressure rotor, located below the combustion chamber, is improved:
  - this part is in fact a complex element of the turbine engine and must satisfy numerous dimensioning criteria. For turbine engines with small dimensions and with elevated performance imperatives (in fuel consumption and emissions), it is tempting to select a high rotation speed: the difficulty then being to ensure stiffness and acceptable shaft dynamics. Thus, the elbowed shape given to the flame tube allows a reduction in the length of the high-pressure shaft (constituted by a high pressure compressor upstream of the combustion chamber and the high pressure turbine downstream of the combustion chamber);
- the interface with the high pressure turbine is improved:
  - in fact, the outlet of the flame tube is collinear with the design of the HPD platforms: this allows limiting the number of lines of hot flow current which would impact the wall (particularly on the outer shroud) and could potentially interfere with cooling of these parts, the lifetime whereof is critical the ignition plug can be positioned at different positions: at the chamber base and/or at the corner of the chamber and/or on the outer wall.

PRESENTATION OF THE FIGURES

Other features, aims and advantages of the invention will be revealed by the description that follows, which is purely illustrative and not limiting, and which must be read with reference to the appended drawings other than FIG. 1, already discussed, FIG. 2 illustrates a section view of a combustion chamber;

In all the figures, similar elements bear identical reference symbols.

DETAILED DESCRIPTION OF THE INVENTION

Figure 2:
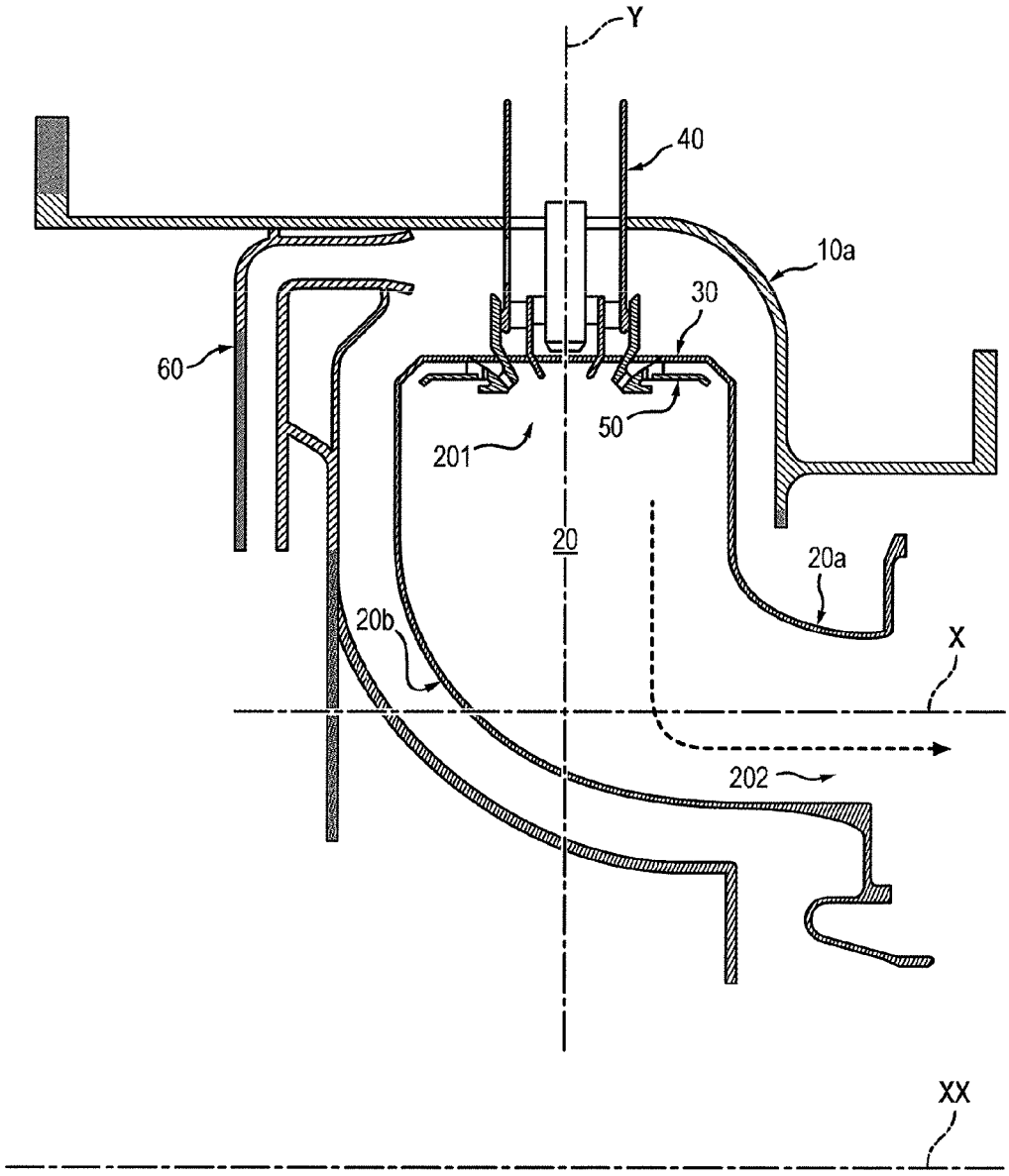
Figure 3:
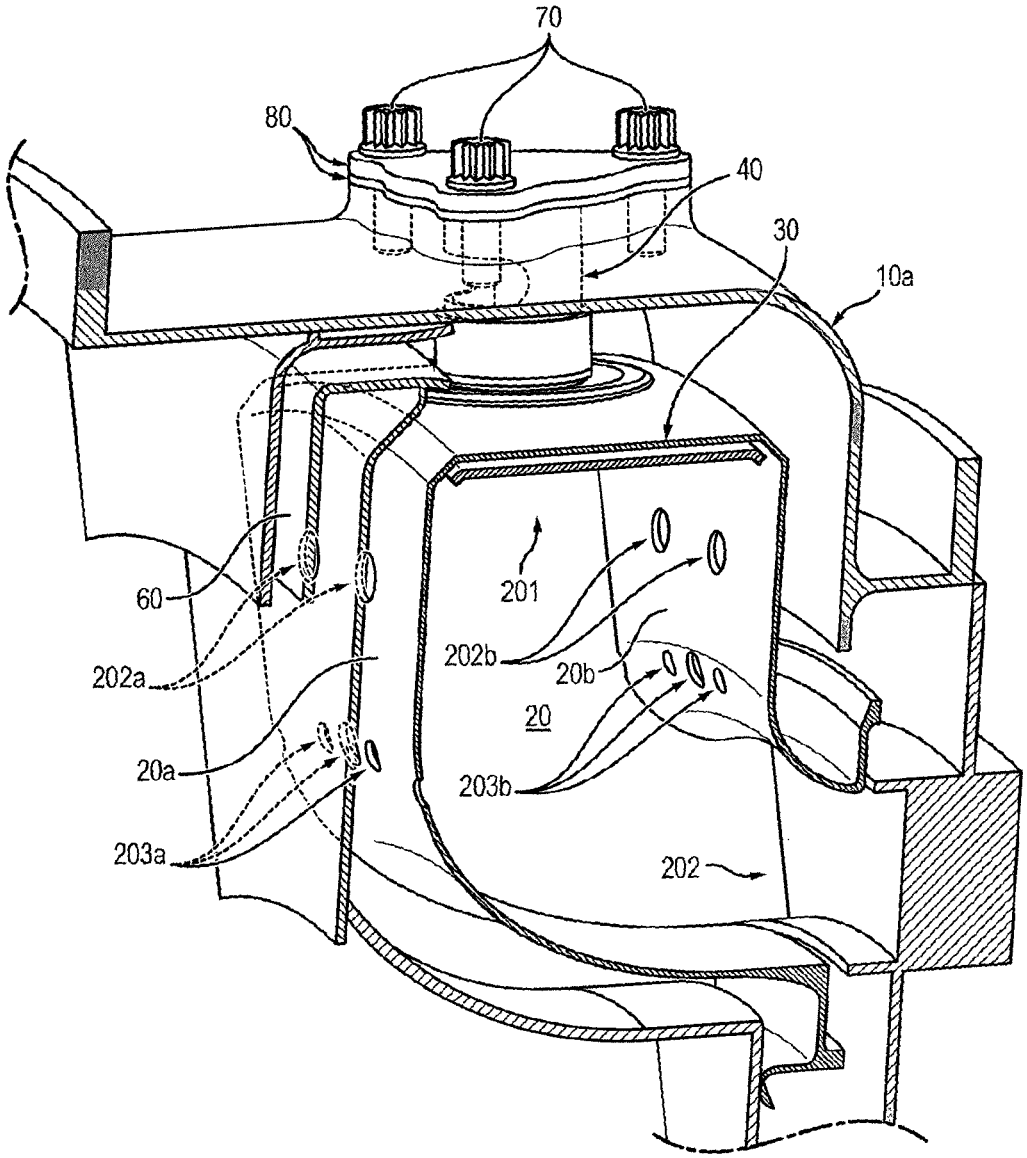
FIG. 3 illustrates a perspective view of a combustion chamber.

FIGS. 2 and 3 illustrate views of a combustion chamber according to one embodiment.

The combustion chamber comprises an outer casing 10*a* to which a flame tube 20 is connected.

The flame tube 20 comprises an inner annular wall 20*a* and an outer annular wall 20*b*.

The inner and outer annular walls define, on the one hand, a first radial portion 201 around an axis Y of the combustion chamber and which extends radially with respect to a longitudinal axis of rotation XX of the turbine engine.

On the other hand, the inner and outer annular walls define a second axial portion 202 around a longitudinal axis X perpendicular to the radial axis Y and parallel to the longitudinal rotation axis XX of the turbine engine.

Figure 1:
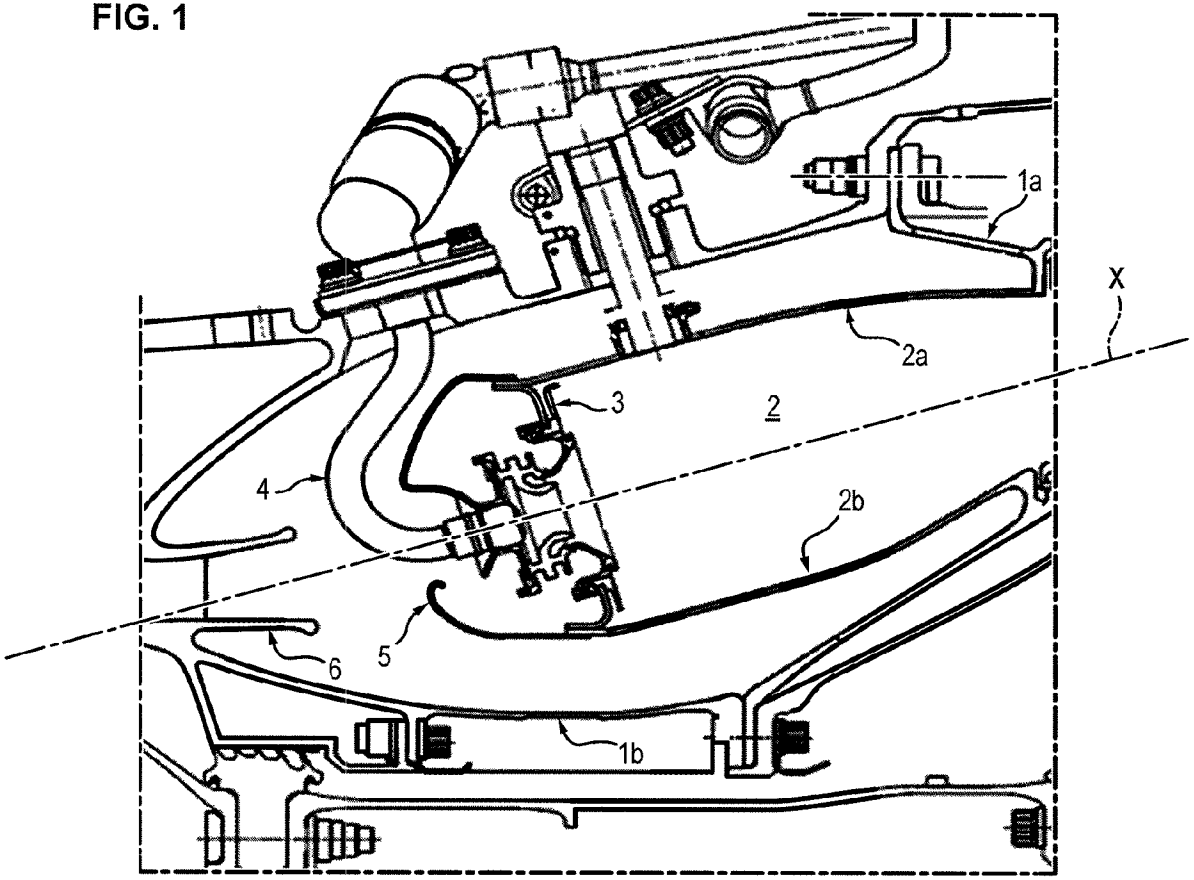

As can be seen in FIGS. 1 and 2, the first portion 201 extends toward the second portion 202 while forming an elbow between the inlet and the outlet of the flame tube.

Such an elbow allows an efficient aerodynamic connection with a high-pressure stage downstream of the gas flow (dotted arrow in FIG. 2).

In addition, this elbowed shape makes it possible to reduce the axial bulk of the flame tube 20.

The combustion chamber also comprises a chamber base 30 which forms a plate situated at the inlet of the flame tube 20.

An injector 40, through which the flame tube 20 is connected to the outer casing 10*a* of the turbine engine is attached to this chamber base 30.

In addition, the combustion chamber can possibly comprise a thermal shield 50 in the form of a plate attached to the chamber base 30 situated in the flame tube 20. This thermal shield 50 is situated at the inlet of the flame tube 20 and protects the injector 40 from high temperatures greater than 2200 K which can occur in the flame tube 20.

Primary holes 202*a*, 202*b* are drilled in the inner and outer annular walls at the first portion 201 at the inlet to the flame tube.

In addition, dilution holes 203*a*, 203*b* are drilled in the inner and outer annular walls at the elbowed portion of the flame tube 20 (see FIG. 3). The number of holes, their respective diameters and positions can vary depending on the intended application.

Figure 4:
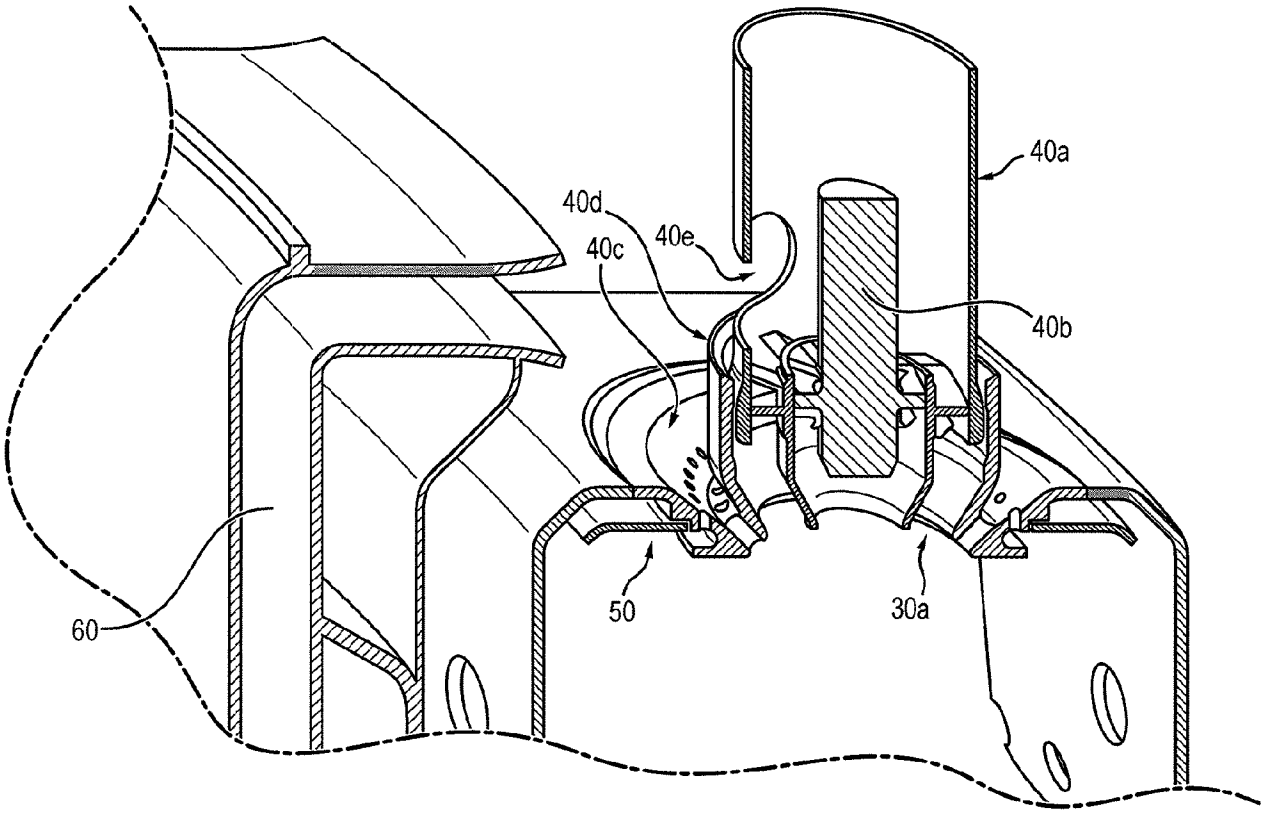
FIG. 4 illustrates a detailed view of the perspective view of FIG. 3.

As can be seen in FIG. 4, the injector 40 comprises an injector body 40*a* surrounding an injection tube 40*b* through which the fuel as such is brought into the flame tube 20. The injector body 40*a* is attached to the outer casing 10*a* through bolts 70 and attachment plates 80 (see FIG. 3).

The inner and outer annular walls are attached to the outer casing 10*a* through the injector body 40*a*, thus allowing simplification of the bowl—chamber base connection and thus avoiding the use of a clearance compensation system.

A connection disk 40*c* topped by a cylinder 40*d* in which is inserted the body 40*a* of the injector is connected to the chamber base 30 in which a recess 30*a* at the size of the connection disk has been provided.

The body 40*a* of the injector is in connection with the injection tube 40*b* and the body 40*a* of the injector 40 is inserted into the cylinder 40*d* topping the connection disk 40*c* in such a manner that the injector body 40*a* (and therefore the injection tube 40*b*) is movable with respect to the cylinder 40*d*. This allows compensation of the movements to which the flame tube 20 is subjected. There is therefore no need for complex compensation systems.

The body 40*a* of the injector comprises an air inlet 40*e* through which the air originating from a diffuser 60 is introduced. This air allows the injector 40 to be cooled. The air inlet 40*e* has the shape of an oval recess formed in the injector body 40*a*.

The invention claimed is:

1. A combustion chamber of a turbine engine, comprising:

an outer annular casing;

a flame tube connected to the outer casing, said flame tube comprising an inner annular wall and an outer annular wall defining a first portion, that is radial, at an inlet of the flame tube and a second portion, that is axial, at an outlet of the flame tube, the first portion extending toward the second portion while forming an elbow between the inlet and the outlet of the flame tube, the flame tube comprises a plate forming a chamber base located at the inlet of the flame tube, the combustion chamber comprising at least one fuel injector configured to inject fuel into the flame tube via the inlet of the flame tube, the flame tube being connected to the outer annular casing by said at least one fuel injector being connected to the chamber base, said at least one fuel injector comprising an injection tube through which fuel is brought into the flame tube and an injector body surrounding the injection tube, said injector comprising a connection disk connected to the chamber base and a cylinder projecting from the connection disk, the injector body being connected to the injection tube, and the injector body is coaxially inserted into the cylinder topping the connection disk and in contact with the cylinder in such a matter that, when the cylinder and the injector body are assembled together, the cylinder is movable with respect to the injector body and the injection tube when the flame tube is subjected to movement so that the movement is compensated, and the injector body extends through an opening in the outer annular casing to connect the flame tube to the outer casing.

2. The combustion chamber according to claim 1, wherein the at least one fuel injector has a main direction coaxial with a longitudinal axis Y along which the first portion extends.

3. The combustion chamber according to claim 1, wherein said inner annular wall and said outer annular wall of the flame tube are connected to the outer casing through the injector body.

4. The combustion chamber according to claim 1, further comprising primary holes drilled in said inner annular wall and said outer annular wall at the first portion and dilution holes drilled in said inner annular wall and said outer annular wall at the elbow of the flame tube.

5. A turbine engine comprising:

the combustion chamber according to claim 1.

6. The combustion chamber according to claim 1, further comprising a thermal shield attached to the chamber base and positioned in the flame tube at the inlet of the flame tube.

7. The combustion chamber according to claim 1, wherein the connection disk includes a plurality of orifices.

8. The combustion chamber according to claim 1, wherein a radially outer face of the injector body is in direct contact with a radially inner face of the cylinder.

9. The combustion chamber according to claim 1, wherein the injector body is in direct contact with the cylinder at a bottom end of the injector body.

* * * * *